US008109055B2

(12) United States Patent
Miller

(10) Patent No.: US 8,109,055 B2
(45) **Date of Patent: *Feb. 7, 2012**

(54) BUILDING PANEL WITH A RIGID FOAM CORE, STUD CHANNELS, AND WITHOUT THERMAL BRIDGING

(76) Inventor: Kenneth Andrew Miller, Henderson, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/825,562

(22) Filed: Jul. 5, 2007

(65) Prior Publication Data

US 2008/0083180 A1 Apr. 10, 2008

Related U.S. Application Data

(60) Provisional application No. 60/849,863, filed on Oct. 5, 2006.

(51) Int. Cl.
*E04C 2/52* (2006.01)
*E04C 1/39* (2006.01)
*E04B 2/72* (2006.01)

(52) U.S. Cl. ..... 52/220.7; 52/269; 52/309.7

(58) Field of Classification Search ..... 52/309.2, 52/309.7, 269, 267, 265, 220.7
See application file for complete search history.

(56) References Cited

U.S. PATENT DOCUMENTS

| | | | | |
|---|---|---|---|---|
| 832,290 | A | | 10/1906 | Brown |
| 3,353,315 | A | | 11/1967 | Barker |
| 4,435,936 | A | | 3/1984 | Rutkowski |
| 4,465,734 | A | | 8/1984 | Laroche et al. |
| 4,628,650 | A | | 12/1986 | Parker |
| 4,641,468 | A | | 2/1987 | Slater |
| 4,641,469 | A | * | 2/1987 | Wood ..... 52/309.12 |
| 4,866,891 | A | | 9/1989 | Young |
| 4,936,069 | A | | 6/1990 | Hunter et al. |
| 5,285,607 | A | * | 2/1994 | Somerville ..... 52/235 |
| 5,384,998 | A | | 1/1995 | Tanaka et al. |
| 5,799,462 | A | * | 9/1998 | McKinney ..... 52/742.13 |
| 5,842,276 | A | | 12/1998 | Asher et al. |

(Continued)

FOREIGN PATENT DOCUMENTS

DE 25 03 429 * 7/1976

(Continued)

OTHER PUBLICATIONS

PCT Search Report, PCT/US2007/023886, Jan. 14, 2010.

(Continued)

*Primary Examiner* — Michael Safavi
(74) *Attorney, Agent, or Firm* — Salter IP Law; Jim H. Salter

(57) ABSTRACT

A structural insulated panel includes a rigid foam core without thermal bridging. A particular embodiment includes a rigid foam core having first and second faces, a plurality of stud channels being formed on the first and second faces of the rigid foam core, each of the stud channels being formed in the rigid foam core in an L-shape in cross-section. The particular embodiment includes a plurality of studs being insertable into the plurality of stud channels such that one face of each of the plurality of studs being external to the first and second faces of the rigid foam core and substantially flush with a face of the rigid foam core, each of the plurality of studs being fabricated using no more than four bends to produce a stud with a hat channel shape in cross-section.

4 Claims, 20 Drawing Sheets

U.S. PATENT DOCUMENTS

| | | | | |
|---|---|---|---|---|
| 5,893,248 | A | 4/1999 | Beliveau | |
| 5,943,775 | A | 8/1999 | Lanahan et al. | |
| 6,041,561 | A | 3/2000 | LeBlang | |
| 6,167,624 | B1 | 1/2001 | Lanahan et al. | |
| 6,363,674 | B1 | 4/2002 | Carver | |
| 6,408,594 | B1 | 6/2002 | Porter | |
| 6,742,974 | B2 * | 6/2004 | Haire | 52/309.2 |
| 6,796,093 | B2 | 9/2004 | Brandes | |
| 2002/0170250 | A1 * | 11/2002 | Chambers | 52/270 |
| 2005/0204697 | A1 | 9/2005 | Rue | |
| 2005/0257494 | A1 | 11/2005 | Brandes | |
| 2006/0075701 | A1 | 4/2006 | Cretti | |
| 2006/0117689 | A1 | 6/2006 | Onken | |
| 2007/0227086 | A1 | 10/2007 | Beavers et al. | |
| 2008/0083180 | A1 | 4/2008 | Miller | |
| 2008/0250740 | A1 | 10/2008 | Miller | |
| 2009/0235598 | A1 | 9/2009 | Miller | |

FOREIGN PATENT DOCUMENTS

| | | | |
|---|---|---|---|
| WO | 2009005515 | A1 | 1/2009 |
| WO | 2009117081 | A2 | 9/2009 |

OTHER PUBLICATIONS

PCT Search Report, PCT/US2009/001660, Sep. 30, 2010.

* cited by examiner

FIG. 8
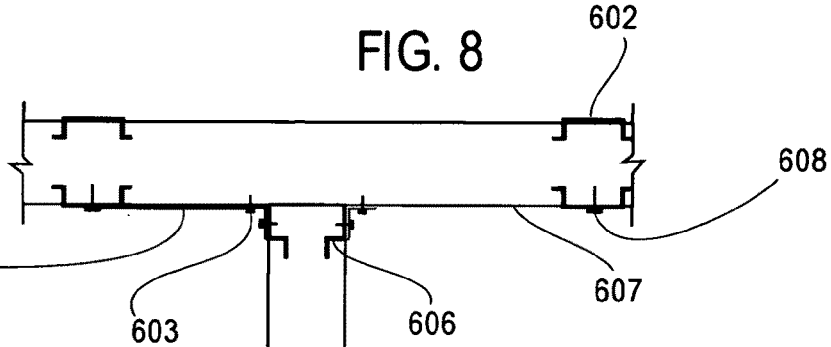
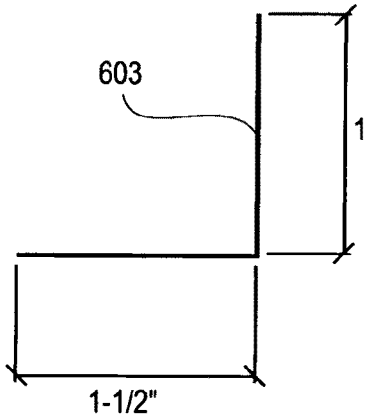
FIG. 7
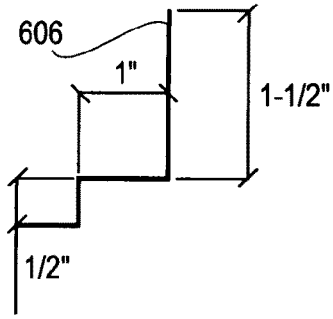
FIG. 9

FIG. 18
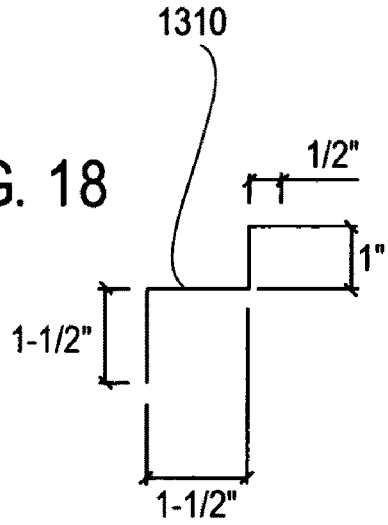
FIG. 20
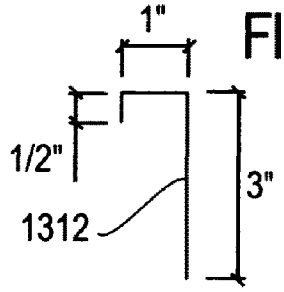
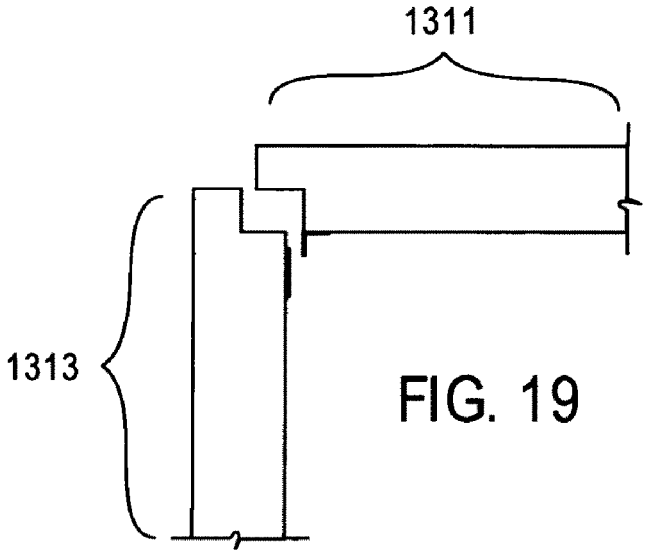
FIG. 19

FIG. 24
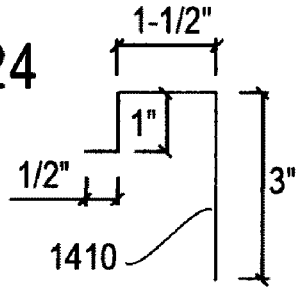
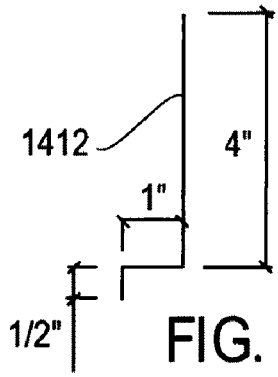
FIG. 25
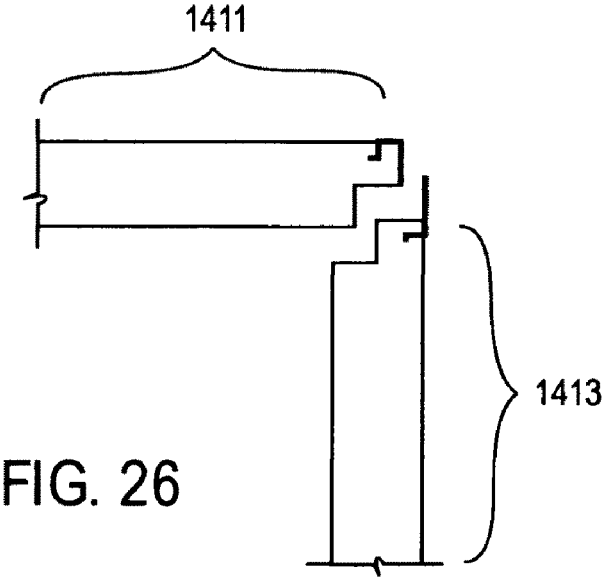
FIG. 26

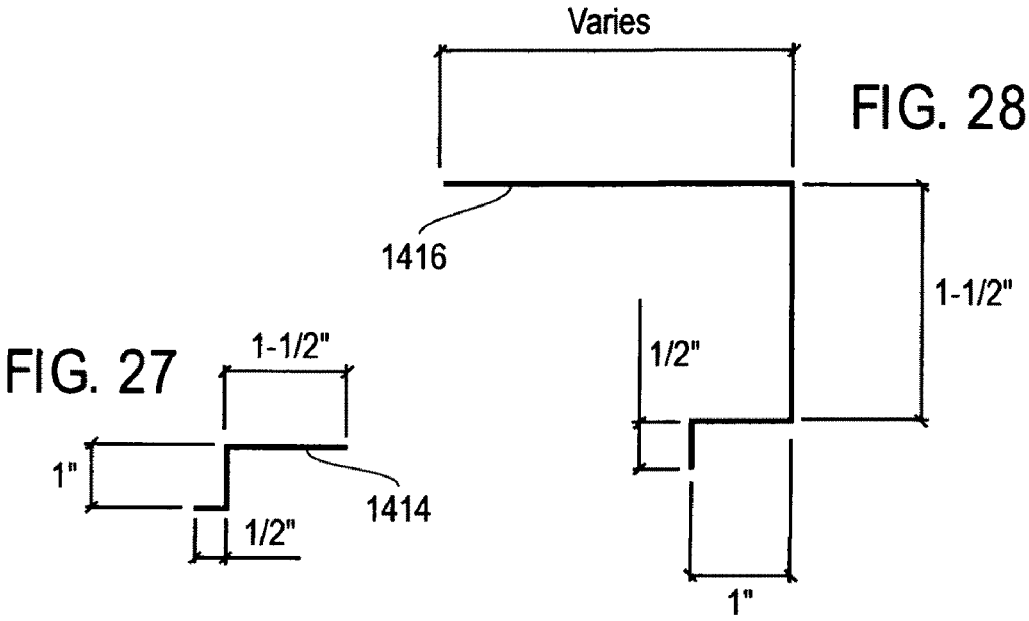
FIG. 28
FIG. 27
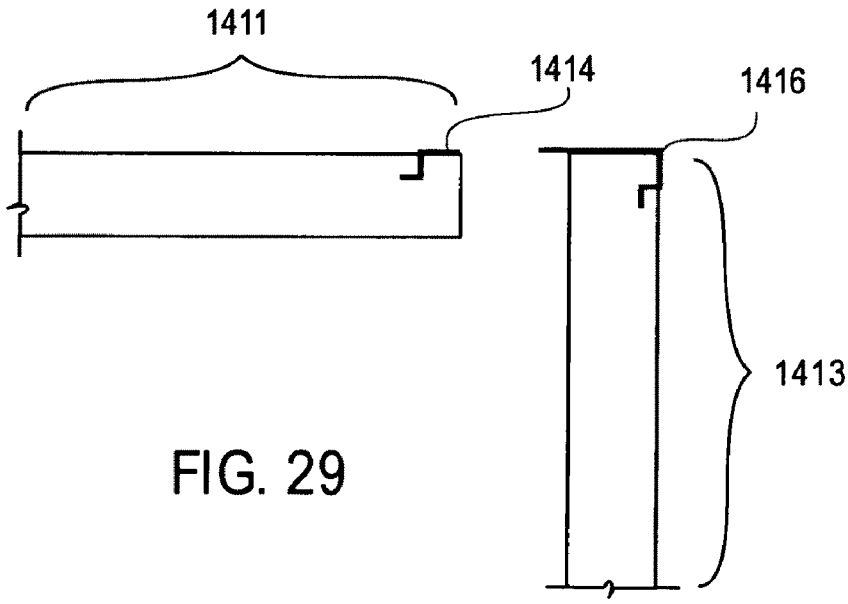
FIG. 29

BUILDING PANEL WITH A RIGID FOAM CORE, STUD CHANNELS, AND WITHOUT THERMAL BRIDGING

PRIORITY APPLICATION

This is a non-provisional patent application that claims priority to a provisional patent application Ser. No. 60/849,863; filed on Oct. 5, 2006; by a common inventor.

BACKGROUND

1. Technical Field

This disclosure relates to insulated structural panels used in building construction. In particular, the present disclosure relates to insulated structural panels including a combination of structural metal components and rigid foam insulation.

2. Related Art

Traditional building construction typically uses wood or metal stud framing with fiberglass insulation enclosed with a drywall interior wall and a wood or stucco exterior wall. These types of conventional structures do not have efficient thermal insulating properties, use many types of non-recyclable materials, and are labor-intensive to build.

More recently, prefabricated panels made of two sheets of plywood or oriented strand board (OSB) with rigid foam insulation between the boards have been used to construct walls, floors, and/or roofs of buildings. These prefabricated panels, called "structural insulated panels" (SIP) may be fabricated at a manufacturing plant and shipped to a jobsite for rapid erection of a building. The SIP's are stronger and have better insulation properties than a framed lumber building. However, SIP's also have inefficient thermal insulation properties and can be susceptible to insect infestation, wood decay from excessive trapped moisture, mold, and/or mildew.

U.S. Patent Application Publication No. 20060117689, filed on Nov. 18, 2005, and names Ronnie and Yelena Onken as inventors (herein the Onken patent application) describes an insulated structural panel formed with a rigid foam core, a plurality of vertical hat channels on either face of the rigid foam core, and horizontal top and bottom L-channels on either face of the rigid foam core. The plurality of vertical hat channels on opposing faces of the rigid foam core is attached together so as to compress the rigid foam core, thus adding structural strength to the insulated structural panel. However, the ties used to attach the hat channels in the Onken patent application create undesirable thermal bridging between the opposing faces of the rigid foam core. This undesirable thermal bridging reduces the thermal insulation efficiency of the Onken panel. Further, the vertical hat channel described in the Onken patent application is expensive to manufacture and uses an excessive amount of material in the fabrication of the hat channel.

Typical existing SIP's that utilize a rigid foam core and hat channel studs often require a mechanical fastener. Typical existing SIP's that utilize rigid foam core and hat channel studs typically have a void between an opposing face of the studs to allow for the mechanical fastener between the parallel hat channels. This void makes it more difficult to attach interior and exterior sheathing. The mechanical fastener provides a thermal bridge and diminishes the insulating value of the panel making the structure less energy efficient. Typical SIP's that utilize a rigid foam core and hat channel studs have notches that are cut out of the foam. The overall insulating value of the panel is less than a panel without notches cut out. Typical SIP's that utilize a rigid foam core and hat channel studs are glued to adjacent panels, but the connection is still a hinge point with no structural value for bending. Consequently, the panel spans between the top and bottom plates or foundation. Typical SIP's that utilize a rigid foam core and hat channel studs typically have a glued butt connection at the corners. This butt connection is of minimal structural value and does not allow for ready attachment of interior sheathing. Typical SIP's that utilize a rigid foam core and hat channel studs require a stiffened lip to take advantage of the bending strength of the section, due to flange buckling effects seen in sections of this type Thus, a structural insulated panel with a rigid foam core without thermal bridging is needed.

BRIEF DESCRIPTION OF THE DRAWINGS

Embodiments illustrated by way of example and not limitation in the figures of the accompanying drawings, in which:

FIGS. 7-9 illustrate a panel to panel connection (join) in a particular embodiment.

FIGS. 18-31 illustrate an example embodiment of an inner corner joint and an outer corner joint in a particular embodiment.

DETAILED DESCRIPTION

A structural insulated panel with a rigid foam core without thermal bridging is disclosed. In the following description, numerous specific details are set forth. However, it is understood that embodiments may be practiced without these specific details. In other instances, well-known processes, structures and techniques have not been shown in detail in order not to obscure the clarity of this description.

As described further below, according to various example embodiments of the disclosed subject matter described and claimed herein, there is provided systems and methods for fabricating and using a structural insulated panel with a rigid foam core without thermal bridging. In a particular embodiment, the panel includes a 4-bend metal hat channel stud embedded in expanded polystyrene foam (EPS) and connected with metal angle braces at the edges to form a rigid panel suitable for the construction of buildings and the like. In particular embodiments, a novel panel is disclosed that has no thermal or sound bridge between the faces via mechanical fasteners. The disclosed panel of various embodiments is more cost efficient in terms of labor to manufacture and materials due to the absence of a requirement for mechanical fasteners between the parallel hat channel sections. Further, the disclosed panel is more suitable to attachment of interior sheathing and does not require the removal of large portions of foam to place the studs thereby lowering the insulating value of the panel. Further, the disclosed panel of various embodiments provides for composite action between the studs and the foam making the panel much stiffer than one that utilizes a mechanical fastener spaced at intervals along the axial length of the panel sections. Further, the disclosed panel of various embodiments provides a continuous locking connection between adjacent panels to facilitate the transfer of pending from one panel to the next allowing the panel to span in two directions instead of a one way span allowing the panel to carry substantially more load, thereby lowering the cost of materials, labor, and shipping. Further, the disclosed panel of various embodiments does not require the use of stiffeners or ties between studs; because, the rigid foam braces the flanges of the stud. Thus, the stud can be made less expensively with four bends instead of six. This helps not only with bending capacity of the stud but with compressive capacity of the design as well. Various embodiments are described below in connection with the figures provided herein.

Figure 1:
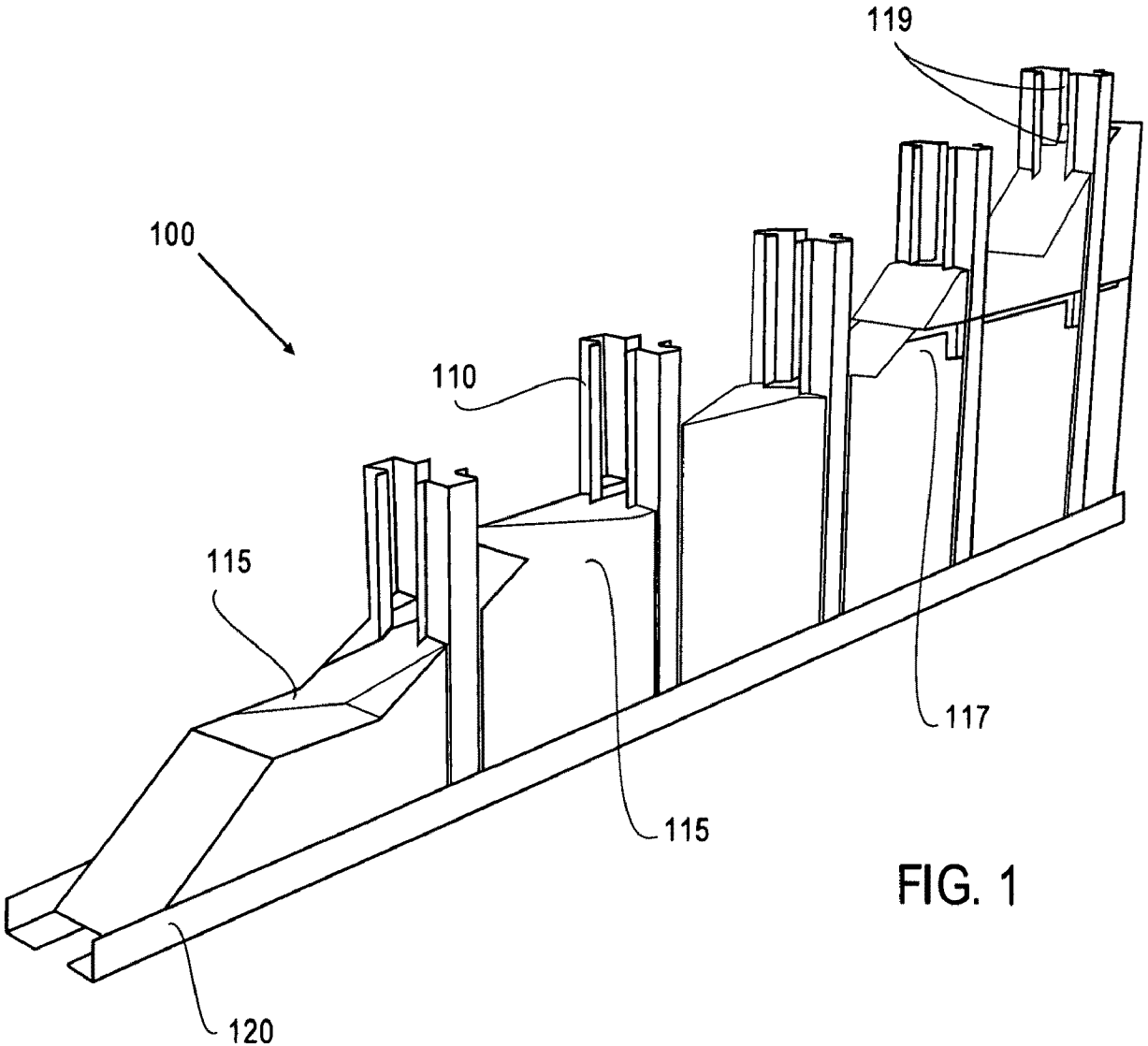
FIG. 1 is a cutaway diagram illustrating an insulated panel according to an example embodiment.

Referring to FIG. 1, a cutaway diagram illustrates an insulated panel 100 comprising one or more studs 110 embedded in expanded polystyrene foam (EPS) 115 and connected with metal angle braces 120 at the edges to form a rigid panel 100. In a particular embodiment, the studs 110 are each a 4-bend metal hat channel stud shown in cross-section in FIGS. 4 and 5. Each stud 110 is embedded in the EPS 115 so that only a single outer face of the stud 110 is substantially flush with the outer face of EPS 115. Angle braces 120, formed in a particular embodiment as an L-shaped member, are connected to studs 110 in a substantially perpendicular arrangement as shown in FIG. 1. Bolts, screws, or welds can be used to bind each stud 110 to the angle braces 120. As shown in FIG. 1, the opposing angle braces 120 capture the EPS 115 at each edge.

As shown in FIG. 1, hat channel studs 110 are not attached to each other (as shown by reference 119) thereby eliminating the presence of a thermal or sound bridge between the faces of the panels. The hat channel studs 110 are embedded into the rigid foam 115 with minimal perturbation to the foam and may be slid into place in a void provided in rigid foam 115. In some cases, a lubricating adhesive including a bonding agent can be used to facilitate sliding stud 110 into rigid foam 115 and locking stud 110 into rigid foam 115 via the adhesive agent. In a particular embodiment, hat channel stud 110 can be produced using no more than four bends to produce a stud with a hat channel shape in cross-section. In various embodiments, additional bends in stud 110 are not necessary as a sufficient level of stiffness is achieved using the structural properties of rigid foam 115 to fully brace the flanges of studs 110. Because studs 110 in various embodiments described herein can be produced with no more than four bends, manufacture of the studs 110 in various embodiments is less expensive, less complicated, and uses less material to produce the stud 110.

Figure 2:
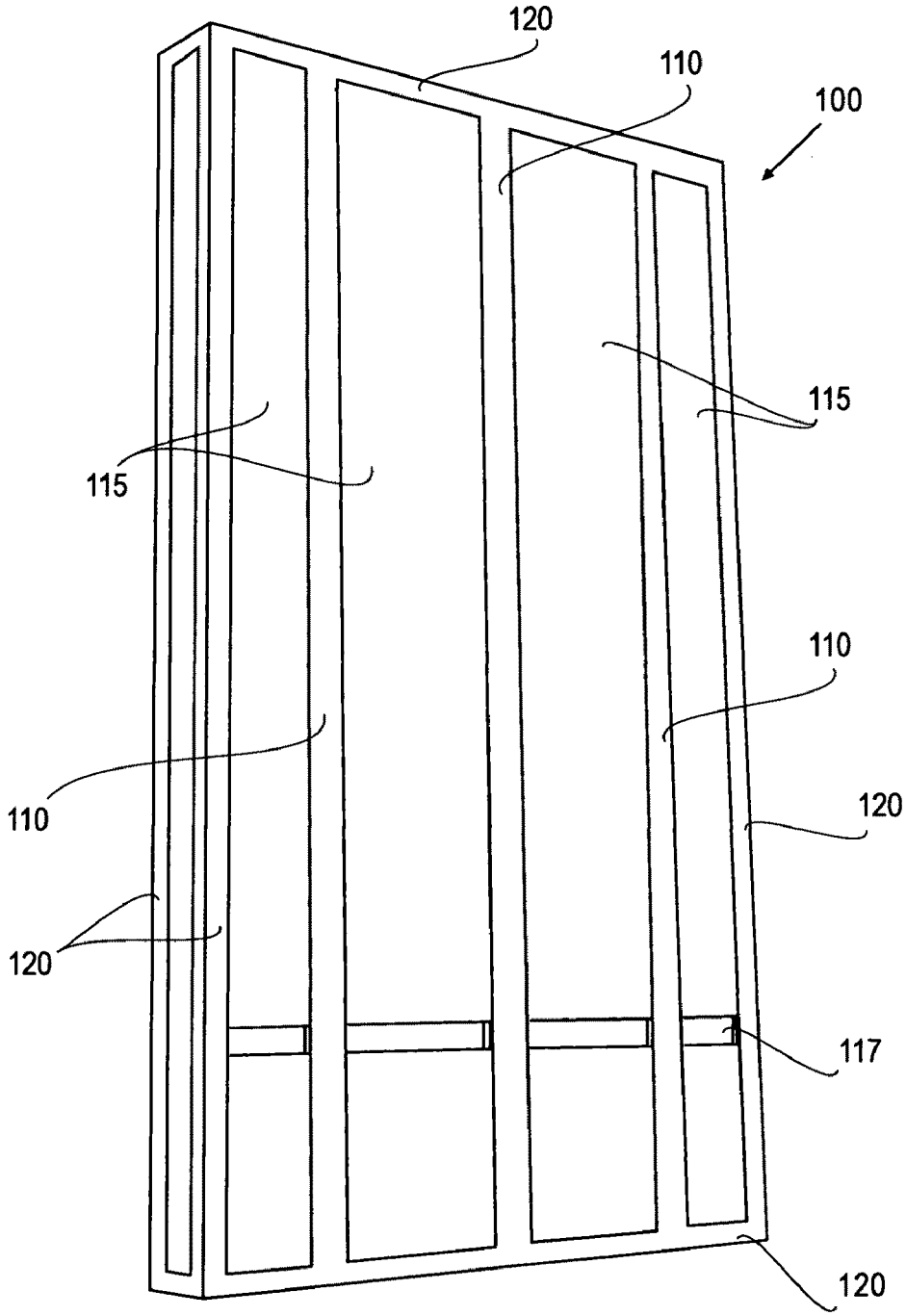
FIG. 2 illustrates a straight panel according to an example embodiment.

FIG. 2 illustrates a straight panel 100 with studs 110, angle braces 120, and rigid foam core 115. An electrical or plumbing chase 117 is also shown as a cut-out portion of the foam 115.

Figure 3:
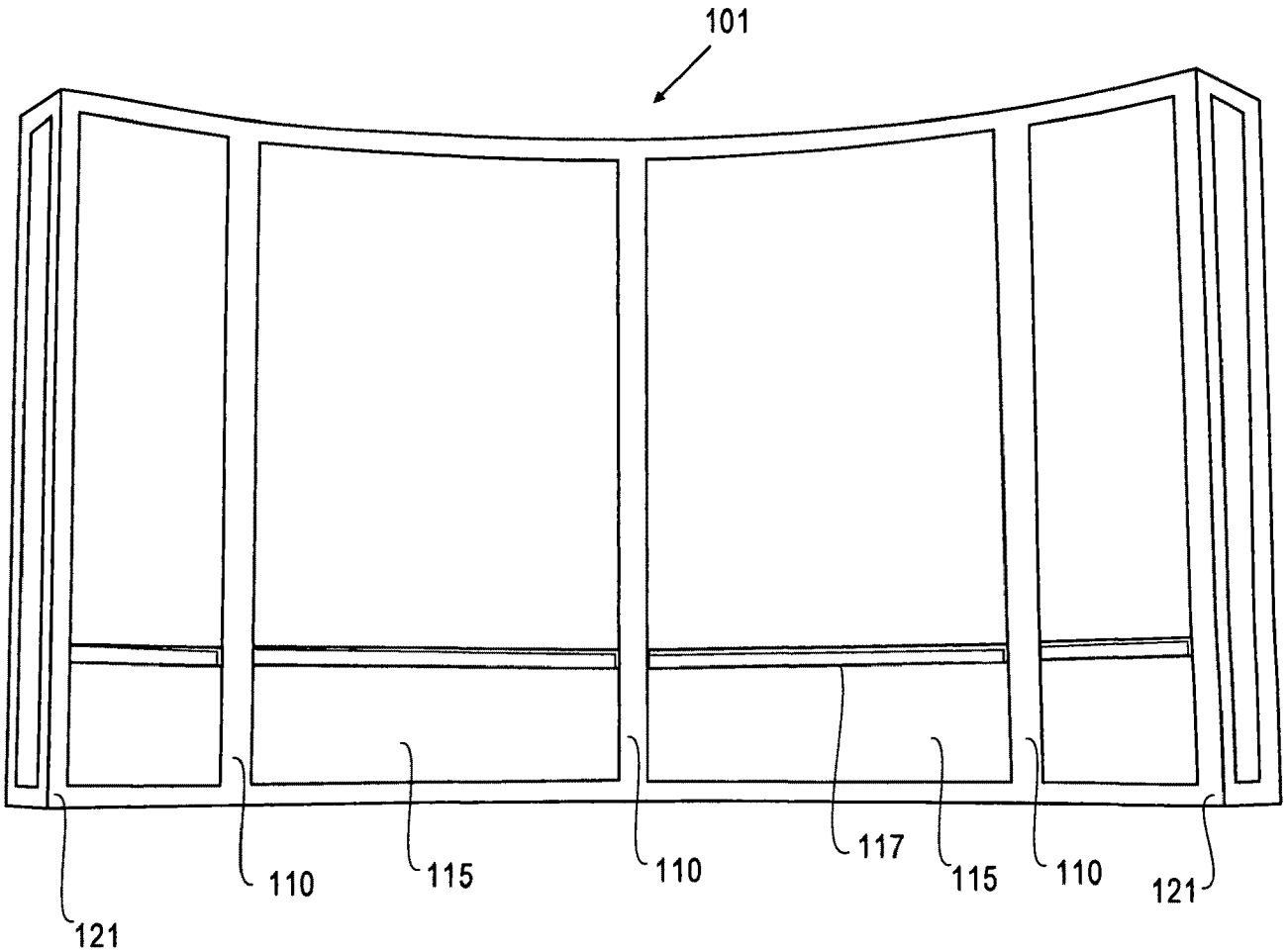
FIG. 3 illustrates a curved panel according to an example embodiment.

FIG. 3 illustrates a curved panel 101 with studs 110, angle braces 120, and rigid foam core 115. An electrical or plumbing chase 117 is also shown as a cut-out portion of the foam 115.

Figure 4:
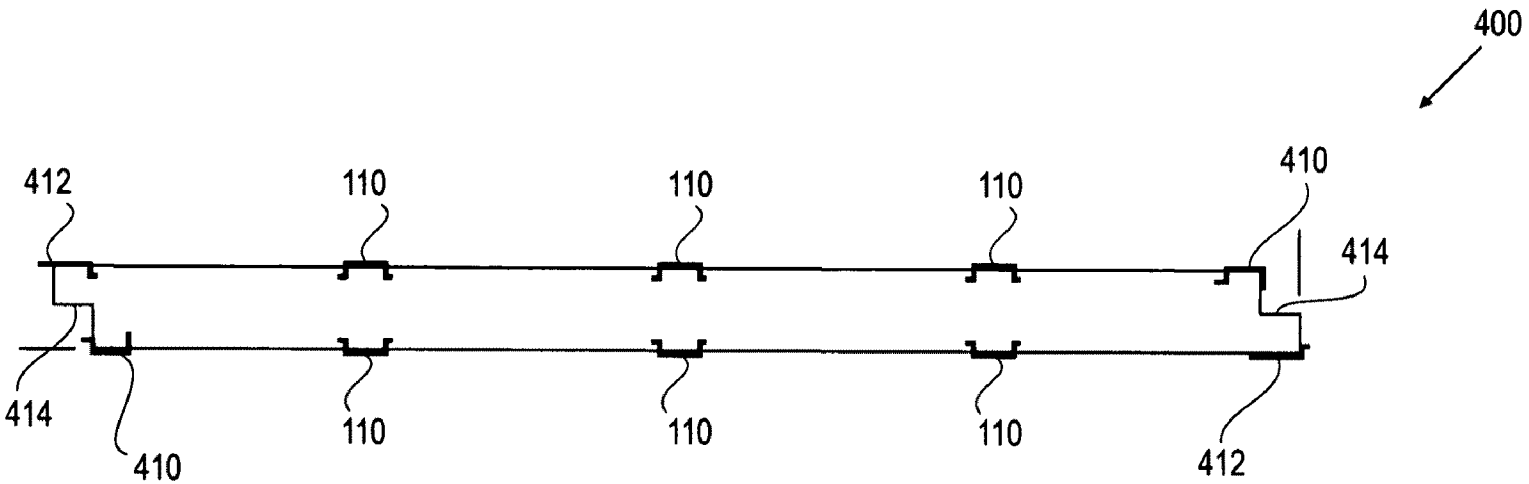
FIGS. 4 and 5 illustrate a straight panel with studs in cross section showing the 4-bend stud according to an example embodiment.
Figure 5:
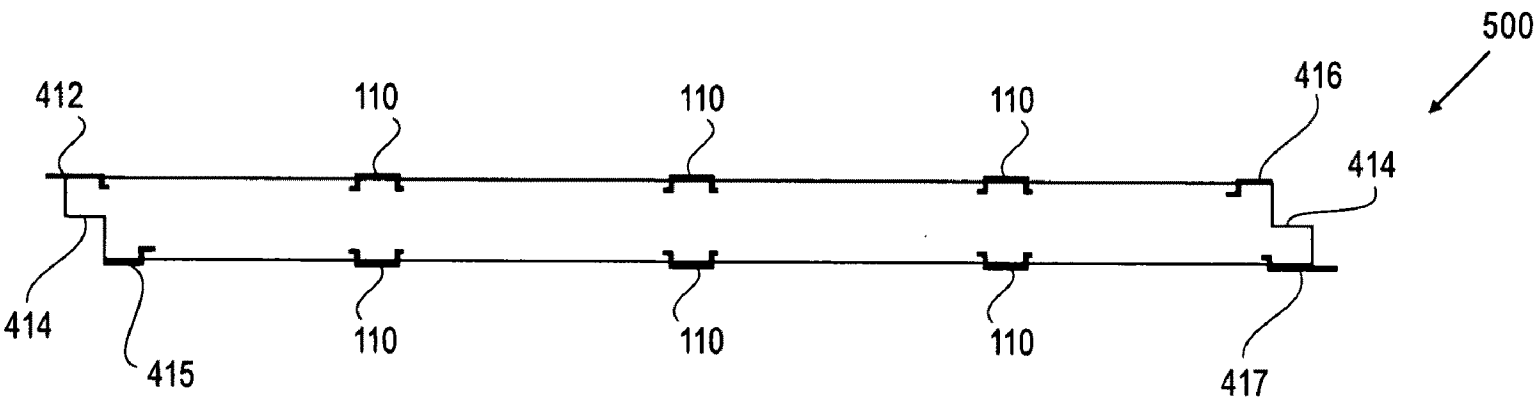

FIGS. 4 and 5 illustrate a straight panel 400 with studs 110 in cross section showing the 4-bend stud. In FIG. 4, a 2-bend flashing hat member 412 is also shown at both ends of the panel. A 3-bend hat member 410 is also shown at both ends of the panel. In FIG. 5, 2-bend flashing hat members 412, 415, 416, and 417 are also shown at both ends of the panel. A lap joint with an expansive adhesive 414 is also shown at both ends of the panel.

Figure 6:
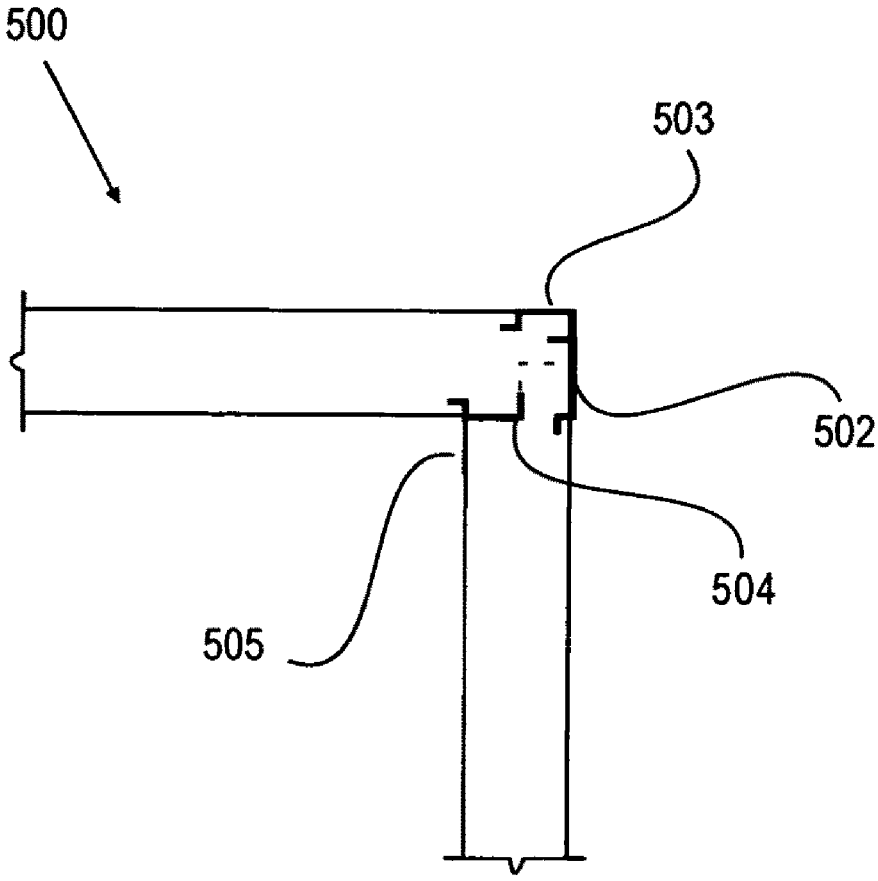
FIG. 6 illustrates a corner lap in a particular embodiment.

FIG. 6 illustrates a corner lap 500 in a particular embodiment. A 2-bend flashing 502 is shown. A 2-bend flashing hat with third field bend 503 is also shown. A lap joint with an expansive adhesive 504 is also shown. A 3-bend hat member 505 is also shown.

FIGS. 7-9 illustrate a panel to panel connection in a particular embodiment. An exterior panel 601 is shown. Studs 602 are also shown. The assembly shown in FIGS. 7-9 is used to join a second panel 605 to panel 601 in a perpendicular orientation. To accomplish this join, a side of panel 601 is fitted with a flat metal strap 607 that can be attached to panel 601 with metal screws or bolts 608 attached at studs 602 as shown in FIGS. 7-9. The join assembly shown in FIGS. 7-9 includes an embedded fitting 606 that includes a first surface that is embedded into panel 605 and a second surface that is exposed at an end of panel 605. In this manner, embedded fitting 606 is secured to panel 605. As shown in FIGS. 7-9, an embedded fitting 606 is provided on both sides of panel 605. The join assembly shown in FIGS. 7-9 further includes a corner fitting 603 that includes a first surface positioned flush with the exposed surface of embedded fitting 606 and secured thereto with a metal screw or bolt. Corner fitting 603 includes a second surface positioned flush with the metal strap 607 on panel 601 and secured thereto with a metal screw or bolt. In this manner, embedded fitting 606 and corner fitting 603 can be used to secure panel 605 to panel 601 in a perpendicular orientation.

Figure 10:
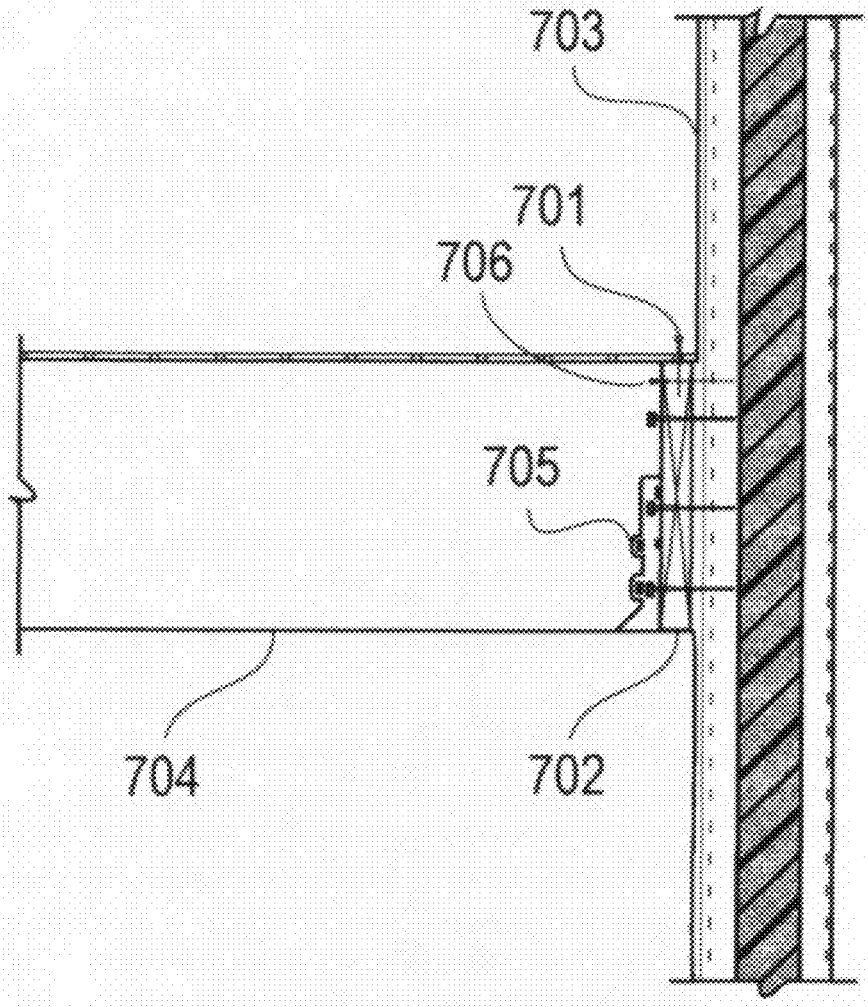
FIG. 10 illustrates a wood joist mounting at a panel in a particular embodiment.

FIG. 10 illustrates a wood joist mounting at a panel in a particular embodiment. An edge nailing 701 is shown. A wood ledger 702 is shown. A shearwall sheathing 703 is shown. A wood joist 704 is shown. A conventional hanger 705 is shown. A block 706 is also shown.

Figure 11:
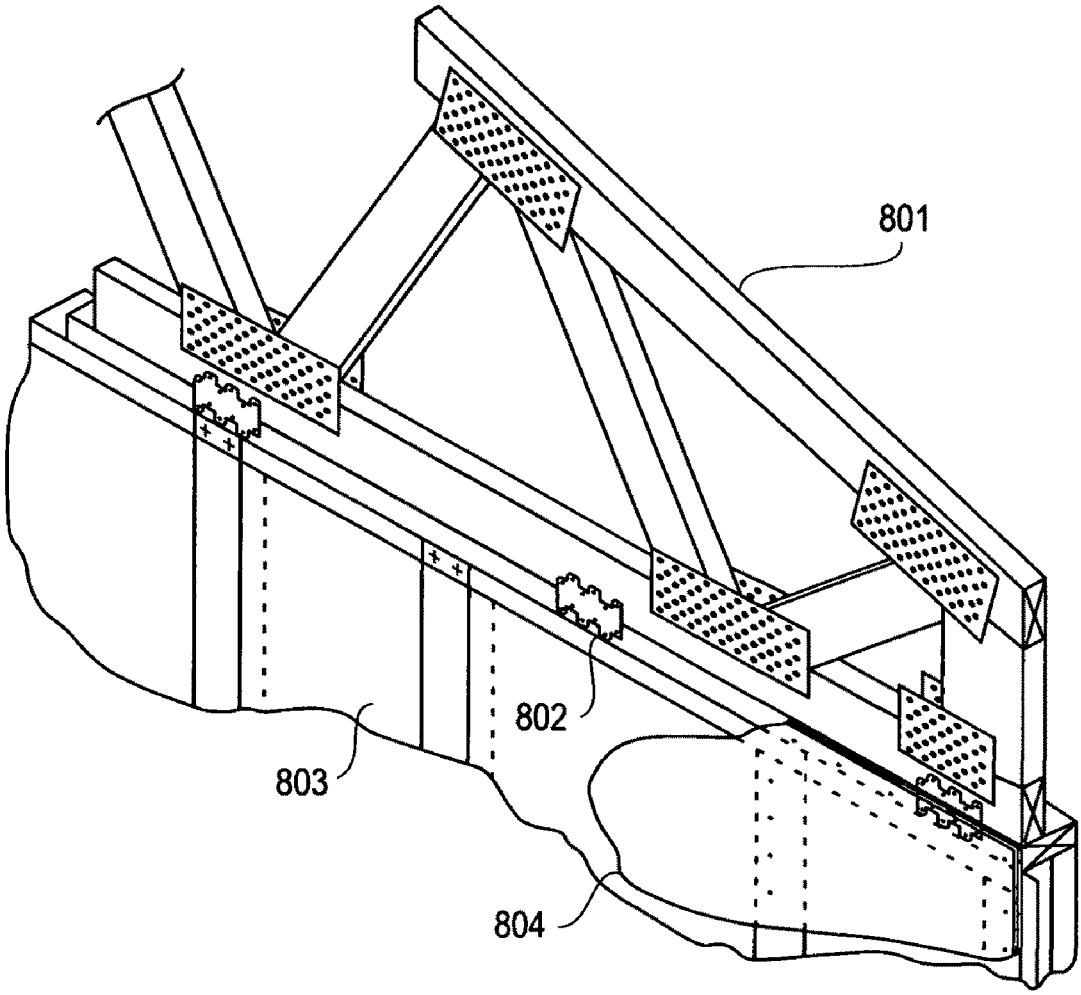
FIG. 11 illustrates a drag truss at a panel in a particular embodiment.

FIG. 11 illustrates a drag truss at a panel in a particular embodiment. A drag truss 801 is shown. A conventional plate 802 is shown. A panel 803 is shown. A shearwall sheathing 804 is shown.

Figure 12:
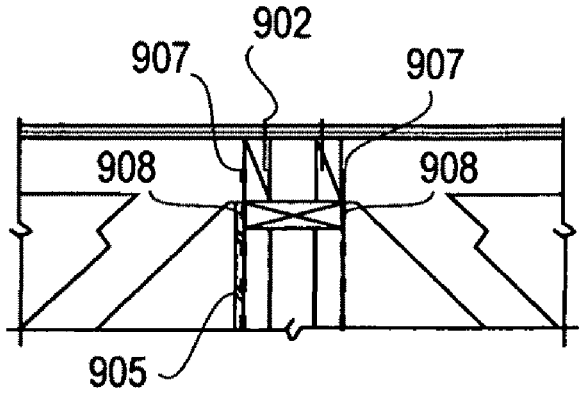
FIGS. 12 and 13 illustrate a wood truss at an interior panel in a particular embodiment.
Figure 13:
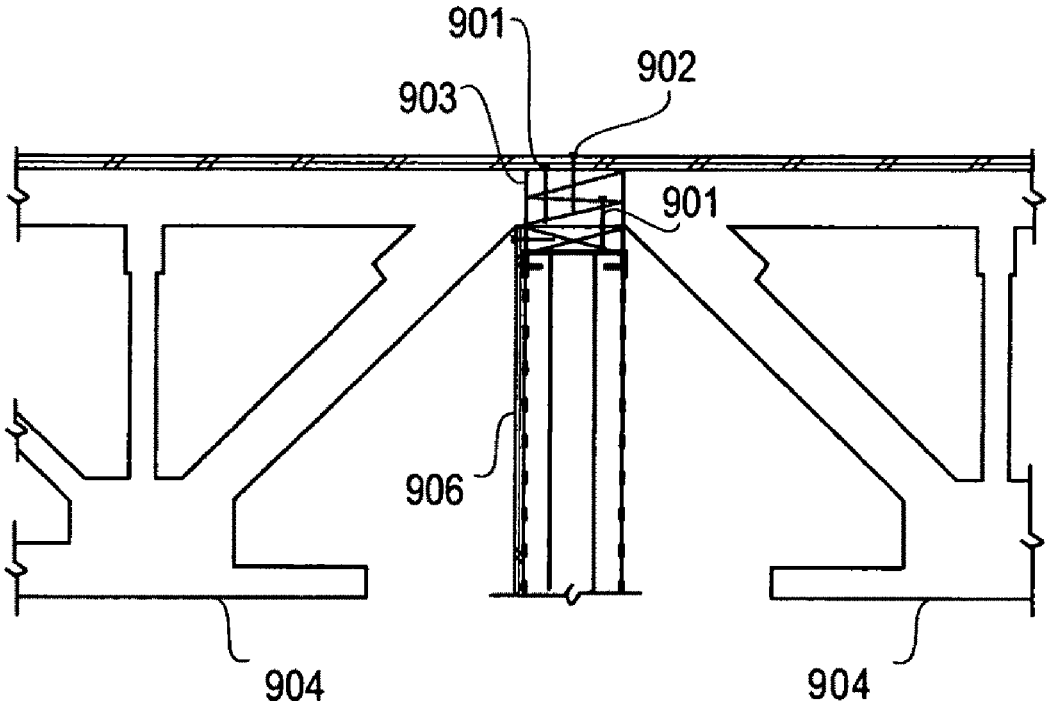

FIGS. 12 and 13 illustrate a wood truss at an interior panel in a particular embodiment. An edge nailing 902 is shown. A block 903 is shown. A top chord bearing truss 904 is shown. A wall panel 905 is shown. A shearwall sheathing 906 is shown. A block 907 is shown.

Figure 14:
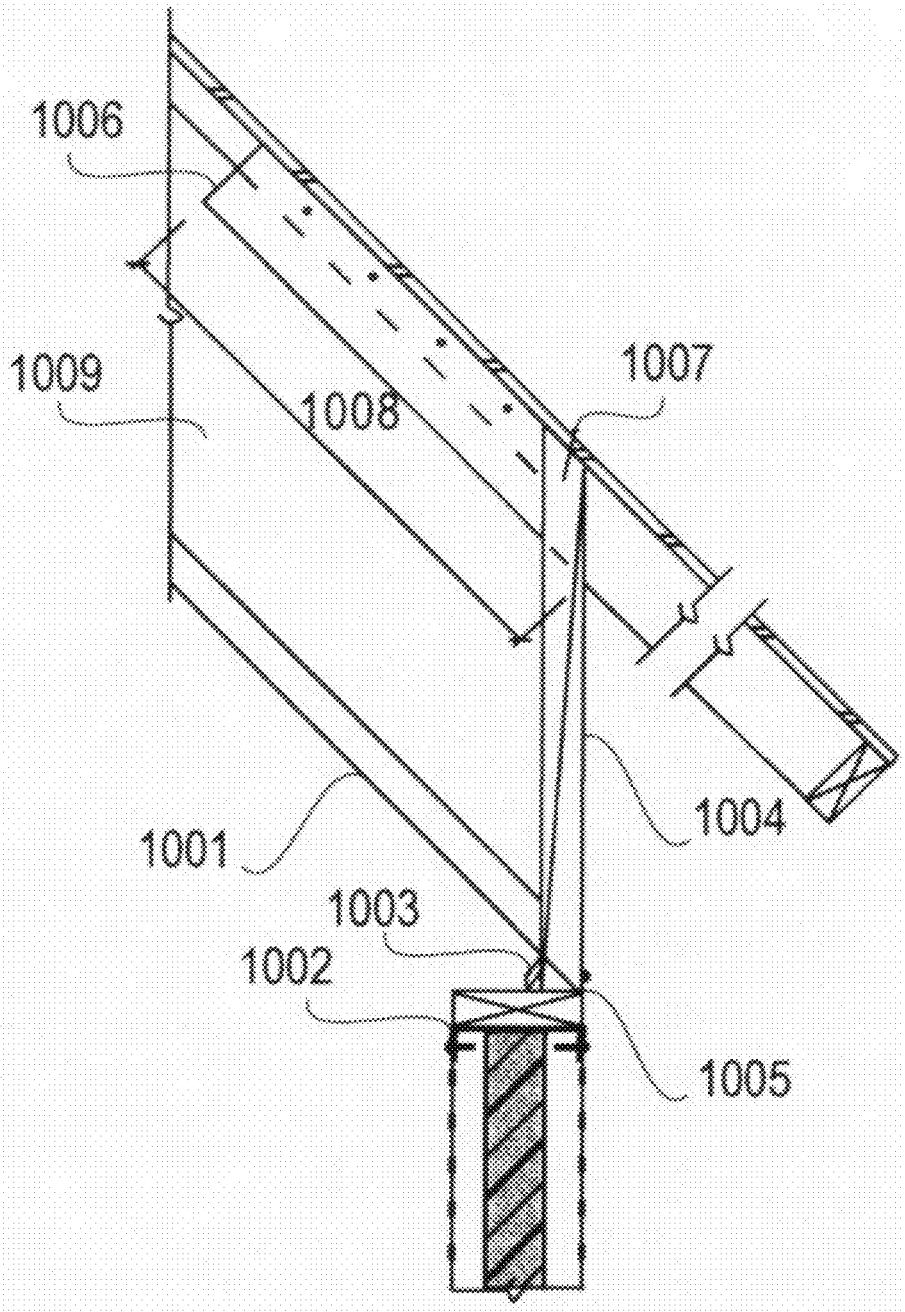
FIG. 14 illustrates a plywood web joist at a wall panel in a particular embodiment.

FIG. 14 illustrates a plywood web joist at a wall panel in a particular embodiment. A plywood web joist 1001 is shown. A panel and top track 1002 is shown. A variable pitch connector 1003 is shown. A top plate blocking 1005 is shown.

Figure 15:
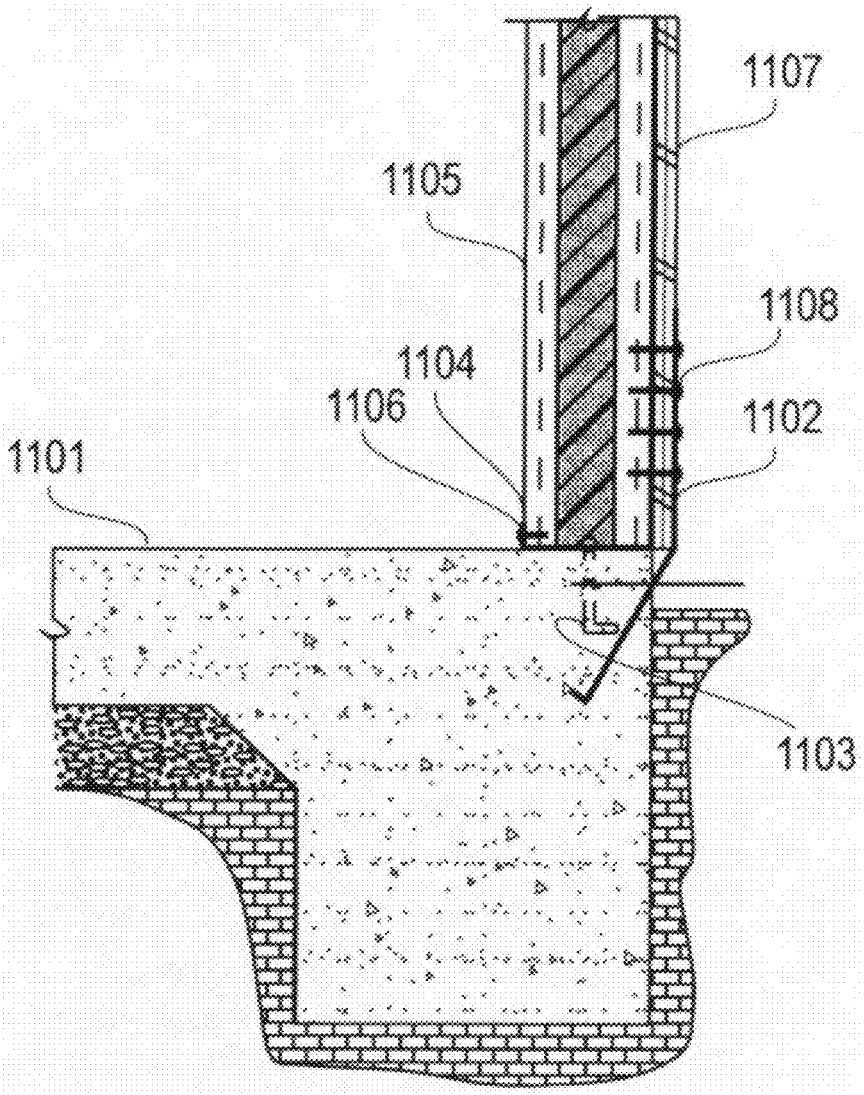
FIG. 15 illustrates an exterior strap holdown at a panel wall in a particular embodiment.

FIG. 15 illustrates an exterior strap holdown at a panel wall in a particular embodiment. A concrete slab or foundation 1101 is shown. A strap holdown 1102 is shown. A track anchorage 1103 is shown. A bottom track 1104 is shown. A panel stud 1105 is shown. Screws 1106 are shown. Exterior sheathing 1107 is shown. Screws 1108 embedded in sheathing 1107 and stud 1105 is also shown.

Figure 16:
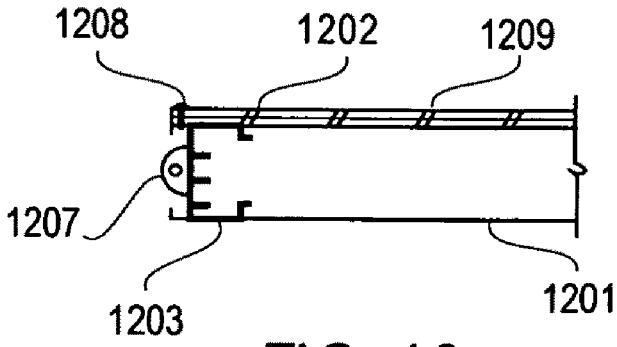
FIGS. 16 and 17 illustrate an interior wall with holdown in a particular embodiment.
Figure 17:
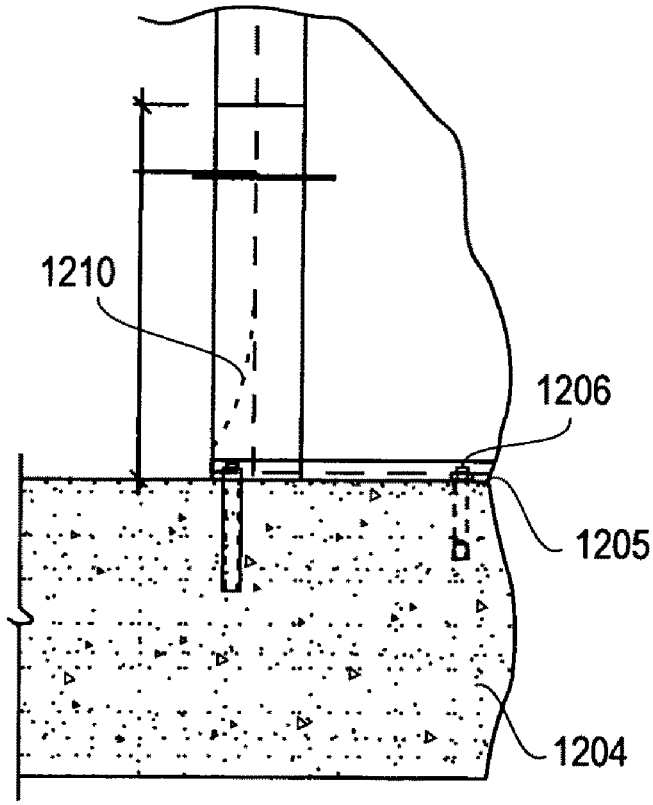

FIGS. 16 and 17 illustrate an interior wall with holdown in a particular embodiment. A panel 1201 is shown. The 3-bend members 1202 and 1203 are shown. A concrete slab 1204 is shown. A panel bottom track 1205 is shown. A track anchorage 1206 is shown. A C-stud 1207 is shown. Screws 1208 are shown. Interior sheathing 1209 is shown. A holdown 1210 is shown.

The new panel configuration of a 4-bend hat channel stud embedded in EPS substantially improves the vertical load carrying capacity of the embedded stud columns; because, the EPS acts to create a continuously braced column, which has much better load-bearing capacity. This improvement in load bearing capacity does not require connecting members between studs or a 6-bend stud.

An additional advantage of the disclosed panel of various embodiments is that the panel can use the expansive nature of the adhesive. The panels can be joined together and screwed with a lap as detailed above in connection with the drawings. As the glue sets, it attempts to force the panels apart putting the connection in tension. This tension minimizes the hinging that is seen between the panels allowing for beam action top to bottom and side to side. A simple example of this is a two way floor slab. A two way floor slab has reinforcement running in both directions and has multiples more load carrying capacity. The disclosed panel of various embodiments will make terrific floor and roof panels that will require far less beam support thereby making them much more efficient to use in these applications as well.

An additional advantage of the disclosed panel of various embodiments involves the lap at the ends. Here, in particular embodiments, a two and two with third field bend hats can be used. This makes all panels (save the electrical and plumbing chases) interchangeable. Having all panels interchangeable is highly advantageous as it makes the necessity for detailed shop drawings obsolete thereby saving time and cost.

An additional advantage of the disclosed panel of various embodiments involves the manner in which interior panels are anchored with post install hold downs as described above in connection with the figures. Having the ability to move a wall and not be concerned with being a couple of inches off could save a great deal in on-site labor and potential work stoppage.

The interaction between the studs and the panel can rely on friction. This action will be amplified once sheathing is added. The compression between the studs, as provided in conventional panel designs (e.g. the Onken patent application), is not necessary when there is enough friction between the channels and the studs to resist the shear that occurs when the panel is in bending. One additional advantage of having the studs embedded into the foam is that the foam is rigid enough to fully brace the flanges of the studs. In absence of the foam, the capacity in bending of the section is limited by local buckling of the flanges and is multiples less than having the flanges fully braced. In a similar fashion, the vertical load carrying capacity of the embedded stud columns is substantially increased as a continuously braced column depending on length and gauge.

An additional advantage of the disclosed panel of various embodiments is that the steel and the expanded polystyrene foam do not release off-gassing from resins, adhesives or chemicals normally used for wood construction. This creates less toxic residue at the manufacturing and building site.

An additional advantage of the disclosed panel of various embodiments is that the panels are fast and easy to install. Anyone can be trained in the site installation of the walls and roofs in just hours—not days, weeks or months. Thus, construction time is shorter and less expensive.

An additional advantage of the disclosed panel of various embodiments is that the panels are resistant to fire, natural disasters, earthquakes, hurricanes, mold, mildew, moisture, insects, rust, and warping. The panels provide diminished air pollutants and dust. Further, the panels are substantially stronger than wood panels and made from 100% recyclable non-toxic materials.

FIGS. 18-31 illustrate an example embodiment of an inner corner joint and an outer corner joint. FIGS. 18-20 illustrate an inner corner joint comprising two components, a first inner corner joint component 1310 and a second inner corner joint component 1312. As shown in FIGS. 18-20, first inner corner joint component 1310 is inserted or formed into an insulated panel 1311 at an inside corner of the insulated panel 1311. Similarly, as shown in FIGS. 18-20, second inner corner joint component 1312 is inserted or formed into an insulated panel 1313 at an inside corner of the insulated panel 1313. In this manner, a flat face of first inner corner joint component 1310 can be made flush with a flat face of second inner corner joint component 1312 when insulated panels 1311 and 1313 are joined at the corners at right angles as shown in FIGS. 18-20. When the flat face of first inner corner joint component 1310 is flush with the flat face of second inner corner joint component 1312, the first inner corner joint component 1310 can be bonded to second inner corner joint component 1312 using a variety of means including, the use of bolts, screws, welds, glue, and the like. When first inner corner joint component 1310 is so bonded to second inner corner joint component 1312, the inventive inner corner joint serves to securely hold the insulated panels 1311 and 1313 in a right angle alignment.

Figure 30:
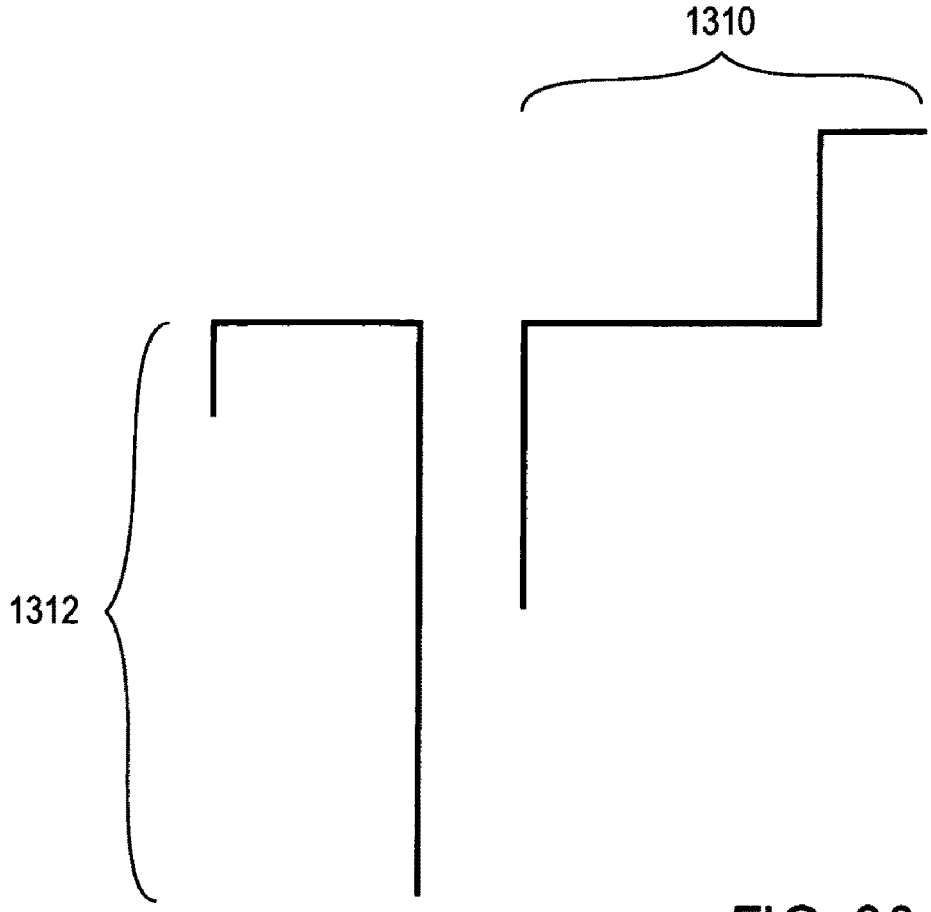

FIG. 30 illustrates a detail of the first inner corner joint component 1310 and the second inner corner joint component 1312. These components can be fabricated from a variety of rigid materials including metal, composites, wood, and the like.

Figure 21:
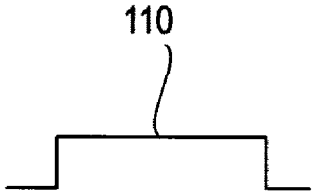
Figure 22:
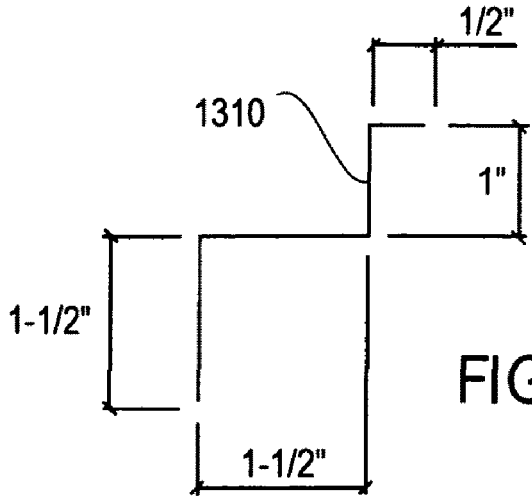
Figure 23:
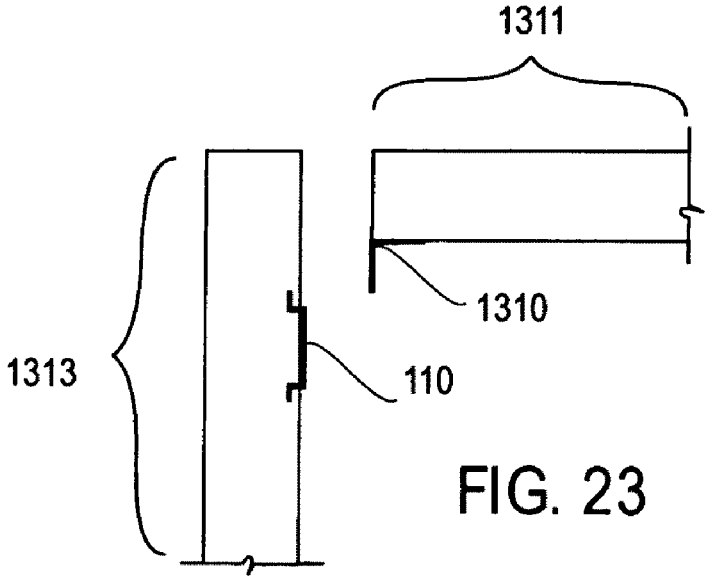

FIGS. 21-23 illustrate another embodiment of an inner corner joint comprising a single join component 1310 and a stud 110. As shown in FIGS. 21-23, join component 1310 is inserted or formed into an insulated panel 1311 at an inside corner of the insulated panel 1311. Similarly, as shown in FIGS. 21-23, stud 110 is inserted or formed into an insulated panel 1313 at an inside surface of the insulated panel 1313. In this manner, a flat face of the join component 1310 can be made flush with a flat face of stud 110 when insulated panels 1311 and 1313 are joined at as shown in FIGS. 21-23. When the flat face of the join component 1310 is flush with the flat face of stud 110, the join component 1310 can be bonded to stud 110 using a variety of means including, the use of bolts, screws, welds, glue, and the like. When join component 1310 is so bonded to stud 110, the inventive inner corner joint serves to securely hold the insulated panels 1311 and 1313 in a right angle alignment.

FIGS. 24-26 illustrate an outer corner joint comprising two components, a first outer corner joint component 1410 and a second outer corner joint component 1412. As shown in FIGS. 24-26, first outer corner joint component 1410 is inserted or formed into an insulated panel 1411 at an outside corner of the insulated panel 1411. Similarly, as shown in FIGS. 24-26, second outer corner joint component 1412 is inserted or formed into an insulated panel 1413 at an outside corner of the insulated panel 1413. In this manner, a flat face of first outer corner joint component 1410 can be made flush with a flat face of second outer corner joint component 1412 when insulated panels 1411 and 1413 are joined at the corners at right angles as shown in FIG. 14A. When the flat face of first outer corner joint component 1410 is flush with the flat face of second outer corner joint component 1412, the first outer corner joint component 1410 can be bonded to second outer corner joint component 1412 using a variety of means including, the use of bolts, screws, welds, glue, and the like. When first outer corner joint component 1410 is so bonded to second outer corner joint component 1412, the inventive outer corner joint serves to securely hold the insulated panels 1411 and 1413 in a right angle alignment.

Figure 31:
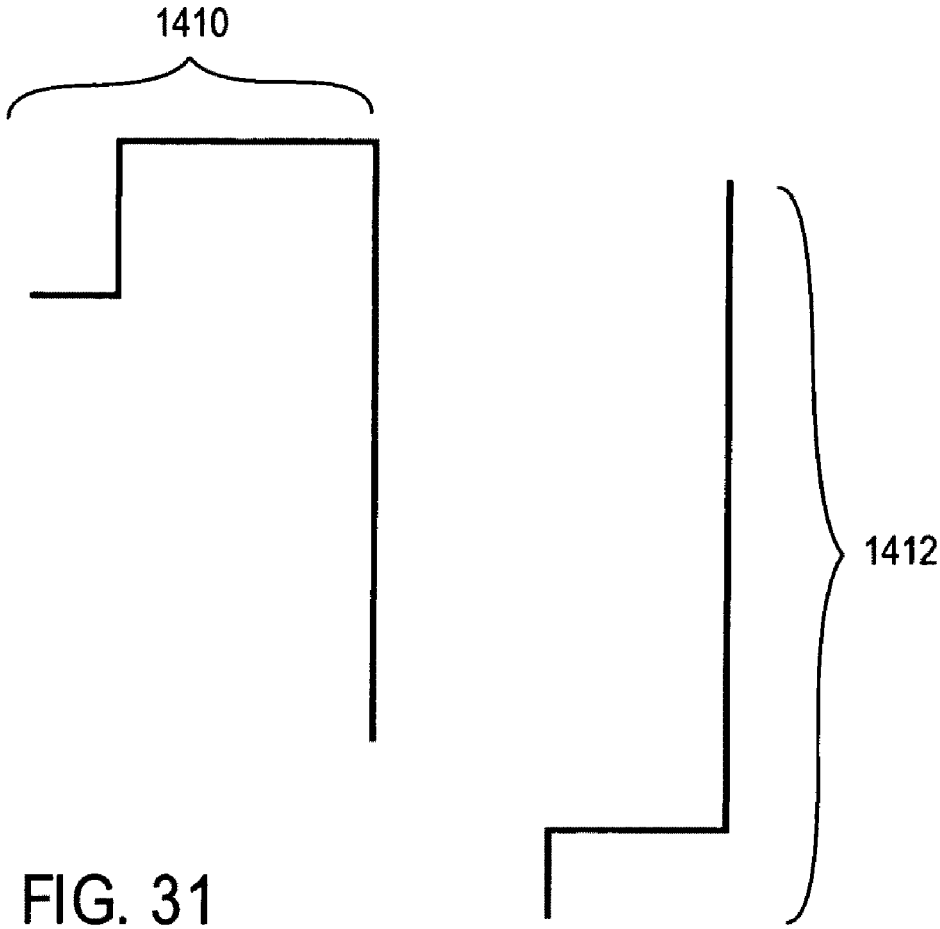

FIG. 31 illustrates a detail of the first outer corner joint component 1410 and the second outer corner joint component 1412. These components can be fabricated from a variety of rigid materials including metal, composites, wood, and the like.

FIGS. 27-29 illustrate an alternative embodiment of an outer corner joint comprising two components, a first outer corner joint component 1414 and a second outer corner joint component 1416. As shown in FIGS. 27-29, first outer corner joint component 1414 is inserted or formed into an insulated panel 1411 at an outside corner of the insulated panel 1411. Similarly, as shown in FIGS. 27-29, second outer corner joint component 1416 is inserted or formed into an insulated panel 1413 at an outside corner and across an edge of the insulated panel 1413. In this manner, a flat face of first outer corner joint component 1414 can be made flush with a flat face of second outer corner joint component 1416 when insulated panels 1411 and 1413 are joined at the corners at right angles as shown in FIGS. 27-29. When the flat face of first outer corner joint component 1414 is flush with the flat face of second outer corner joint component 1416, the first outer corner joint component 1414 can be bonded to second outer corner joint component 1416 using a variety of means including, the use of bolts, screws, welds, glue, and the like. When first outer corner joint component 1414 is so bonded to second outer corner joint component 1416, the inventive outer corner joint serves to securely hold the insulated panels 1411 and 1413 in a right angle alignment.

Figure 32:
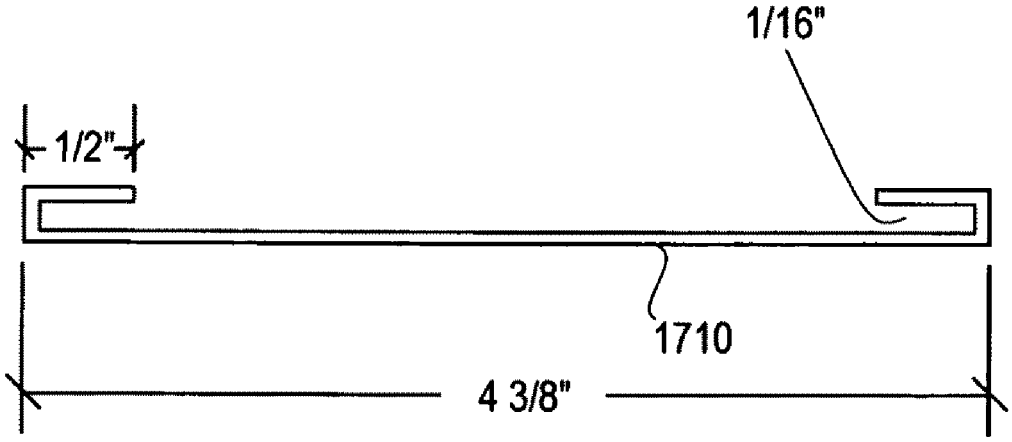
FIG. 32 illustrates a plastic clip used to facilitate the insertion of studs, wiring, plumbing and the like into channels cut into the foam core of a panel.

FIG. 32 illustrates a plastic clip 1710 used to facilitate the insertion of studs, wiring, plumbing and the like into channels cut into the foam core of a structural insulated panel. As shown, the clip 1710, typically fabricated from a polyethylene material, is formed in a shape that can be inserted into a channel in the foam core of a structural insulated panel. A metal stud, brace member, wiring, or plumbing component can then more easily be inserted into the foam core of the structural insulated panel.

Figure 33:
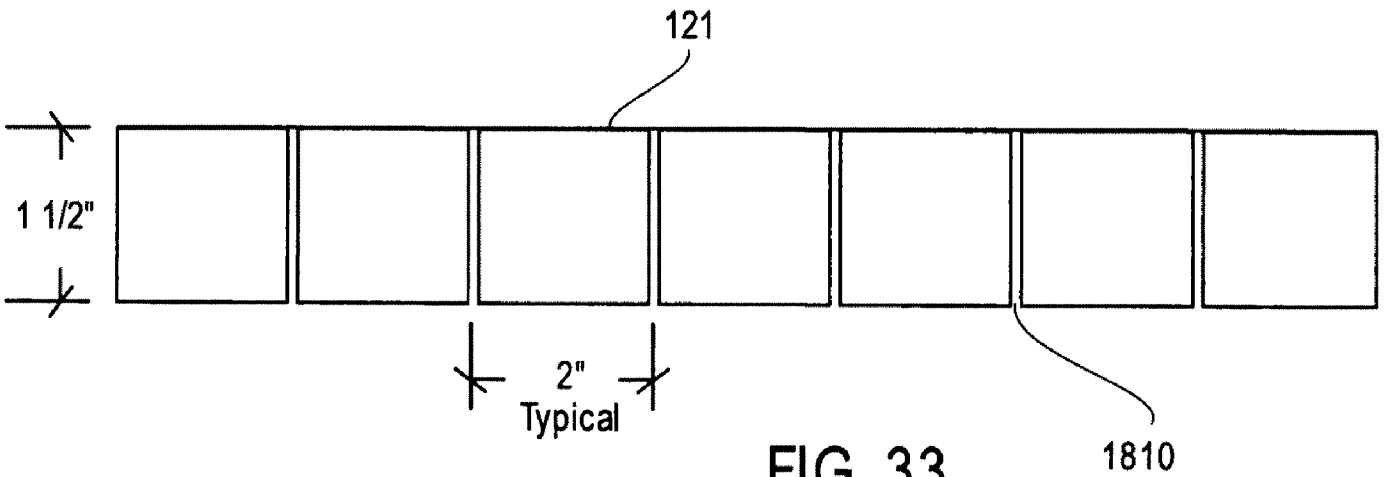
FIGS. 33-34 illustrate the particular structure of the curved angle braces used with the curved panel in an example embodiment.
Figure 34:
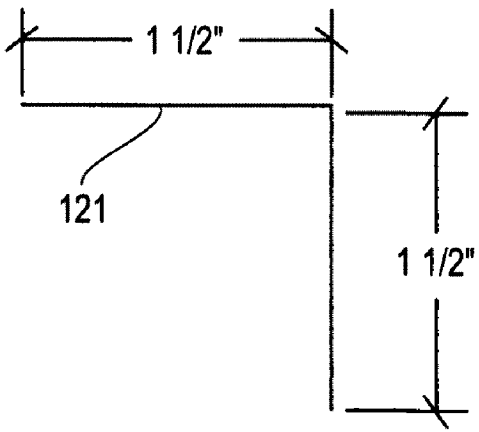

Referring back to FIG. 3, a curved panel 101 is illustrated with studs 110, angle braces 120, and rigid foam core 115. FIGS. 33-34 illustrate the particular structure of the curved angle braces 121 used with the curved panel 101. Because the curved angle braces 121 must follow and be flush with the inner and outer curved surfaces of curved panel 101, the curved angle braces 121 of one embodiment are notched at several locations as shown in FIGS. 33-34 to enable bending of the rigid curved angle braces 121 without warping. The spacing and width of each notch can be varied depending on the needed level of curve.

Thus, a structural insulated panel with a rigid foam core without thermal bridging is disclosed. While the present invention has been described in terms of several example embodiments, those of ordinary skill in the art will recognize that the present invention is not limited to the embodiments described, but can be practiced with modification and alteration within the spirit and scope of the appended claims. The description herein is thus to be regarded as illustrative instead of limiting.

I claim:

1. A load-bearing building apparatus comprising:

a rigid foam core having first and second faces, a plurality of stud channels being formed vertically on the first and second faces of the rigid foam core, each of the stud channels being formed in the rigid foam core as voids in an L-shape in cross-section, each of the stud channels being formed by cutting L-shape channels into the rigid foam core thereby enabling slideable insertion of a stud into a void of each L-shape channel, the stud having an L-shaped structure corresponding to the L-shape channel, the stud channels being formed without removing a portion of the rigid foam core between the L-shape channels, each of the stud channels including a lubricating adhesive having been applied thereto, the lubricating adhesive including a lubricating agent to facilitate sliding the stud into the voids of each stud channel, the lubricating adhesive including a bonding agent to lock the stud into each stud channel; and a plurality of studs being slideable into the voids provided by the plurality of stud channels such that one face of each of the plurality of studs being external to either the first or second face of the rigid foam core and substantially flush with either the first or second face of the rigid foam core, each of the plurality of studs being fabricated using no more than four bends and each of the plurality of studs having an L-shaped structure corresponding to the L-shape channel, wherein each of the plurality of studs has a hat channel shape in cross-section, and wherein opposing studs of the plurality of studs are not coupled using a structural member running through the rigid foam core and creating a thermal bridge, the plurality of studs providing a vertical load carrying capacity for the load-bearing building apparatus.

2. The building apparatus as claimed in claim 1 including angle braces attached between the plurality of studs in a substantially perpendicular direction relative to the plurality of studs.

3. The building apparatus as claimed in claim 1 wherein either the first or second face of the rigid foam core includes a chase formed in the rigid foam core.

4. The building apparatus as claimed in claim 1 wherein an end of the rigid foam core is configured with a lap joint.

* * * * *